US009151562B1

(12) United States Patent
Pugliese

(10) Patent No.: US 9,151,562 B1
(45) Date of Patent: Oct. 6, 2015

(54) LOCKING ADJUSTABLE RIFLE STAND

(71) Applicant: Carl Pugliese, Chandler, AZ (US)

(72) Inventor: Carl Pugliese, Chandler, AZ (US)

( * ) Notice: Subject to any disclaimer, the term of this patent is extended or adjusted under 35 U.S.C. 154(b) by 0 days.

(21) Appl. No.: 14/180,347

(22) Filed: Feb. 13, 2014

Related U.S. Application Data

(60) Provisional application No. 61/764,284, filed on Feb. 13, 2013.

(51) Int. Cl.
*F41A 23/14* (2006.01)

(52) U.S. Cl.
CPC ..... *F41A 23/14* (2013.01)

(58) Field of Classification Search
CPC ..... F41A 23/02; F41A 23/16; F41A 23/10; F41A 23/06; F41A 23/14; F41A 99/00; F41A 23/12; F41A 25/04; F16M 11/26; F16M 11/245; A01M 31/02; E04H 15/04; A45B 3/14
USPC ..... 42/94; 89/37.04, 37.13
See application file for complete search history.

(56) References Cited

U.S. PATENT DOCUMENTS 5,711,103 A 1/1998 Keng
5,794,899 A * 8/1998 Tamllos ..... 248/166
5,930,933 A 8/1999 Schleicher
6,574,899 B1 6/2003 Mostello
7,493,719 B2 2/2009 Lackey
7,631,455 B2 12/2009 Keng et al.
7,730,824 B1 * 6/2010 Black ..... 89/37.03
7,779,572 B2 8/2010 Potterfield et al.
7,845,267 B2 12/2010 Potterfield et al.
7,845,602 B1 * 12/2010 Young et al. ..... 248/125.8
7,997,021 B2 8/2011 Cauley et al.
8,011,129 B2 9/2011 Cauley et al.
8,132,351 B2 3/2012 Potterfield et al.
8,146,876 B1 4/2012 Young et al.
8,251,330 B2 8/2012 Stabler
8,549,786 B1 * 10/2013 Griffith ..... 42/94
2007/0000852 A1 * 1/2007 Wajchert ..... 211/64

* cited by examiner

*Primary Examiner* — Troy Chambers
*Assistant Examiner* — Bridget Cochran
(74) *Attorney, Agent, or Firm* — James L. Farmer

(57) ABSTRACT

Designs and methods are provided for an adjustable rifle stand. In one embodiment the rifle stand includes a three legged support with a moveable head for holding the rifle at a first support location on the rifle forward of the trigger such that the rifle can pivot about the first support location. The rifle stand also includes a rear brace with two extendable legs and a head that holds the rifle at a second support location on the rifle behind the trigger, wherein the lower ends of the legs of the rear brace are pivotally connected to two of the legs of the three legged support. The legs of the rear brace may be extended or contracted by unlocking a leg extension lock in each leg.

12 Claims, 9 Drawing Sheets

LOCKING ADJUSTABLE RIFLE STAND

This application claims the benefit of U.S. Provisional Application No. 61/764,284, filed Feb. 13, 2013, the entire contents of which are hereby incorporated by reference.

TECHNICAL FIELD AND BACKGROUND

The technical field of the present invention relates to adjustable stands for supporting equipment or weapons.

DESCRIPTION OF THE EMBODIMENTS

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
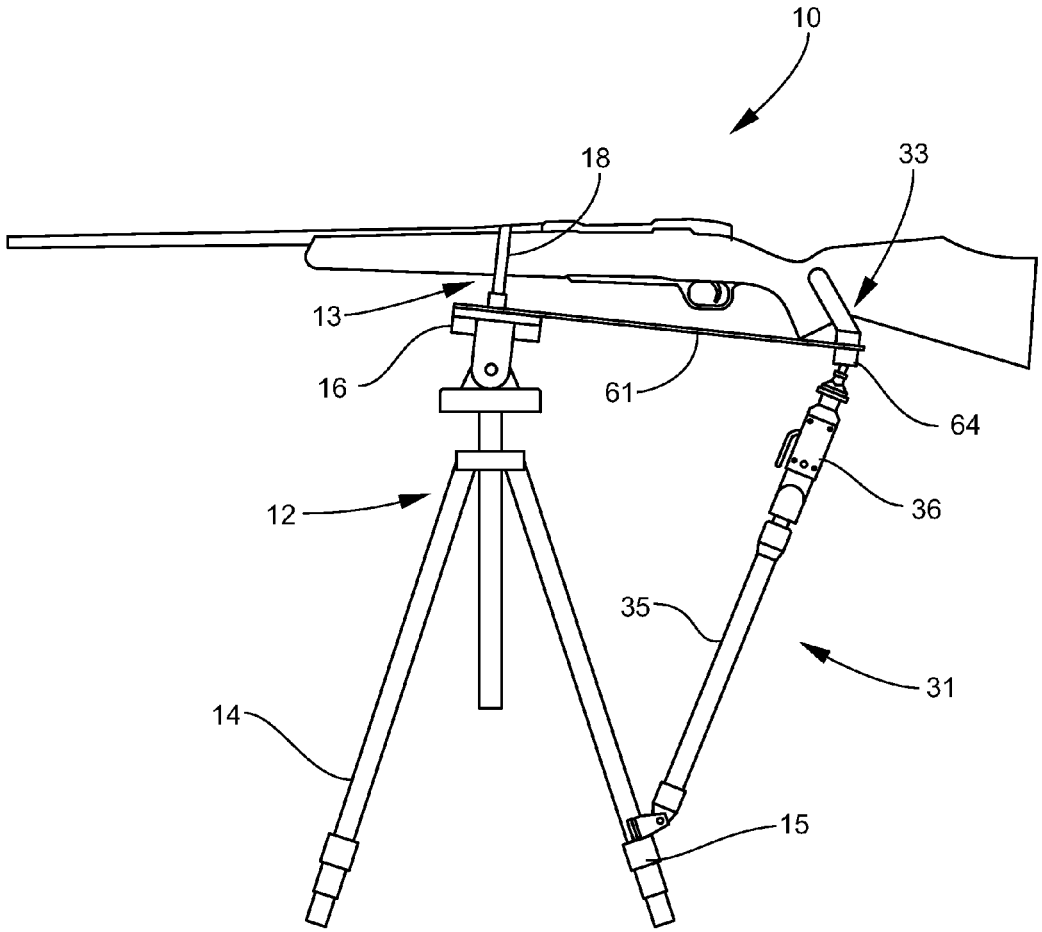
FIG. 1 is a side view of a rifle mounted on an exemplary locking adjustable rifle stand in accordance with the present disclosure.
Figure 2:
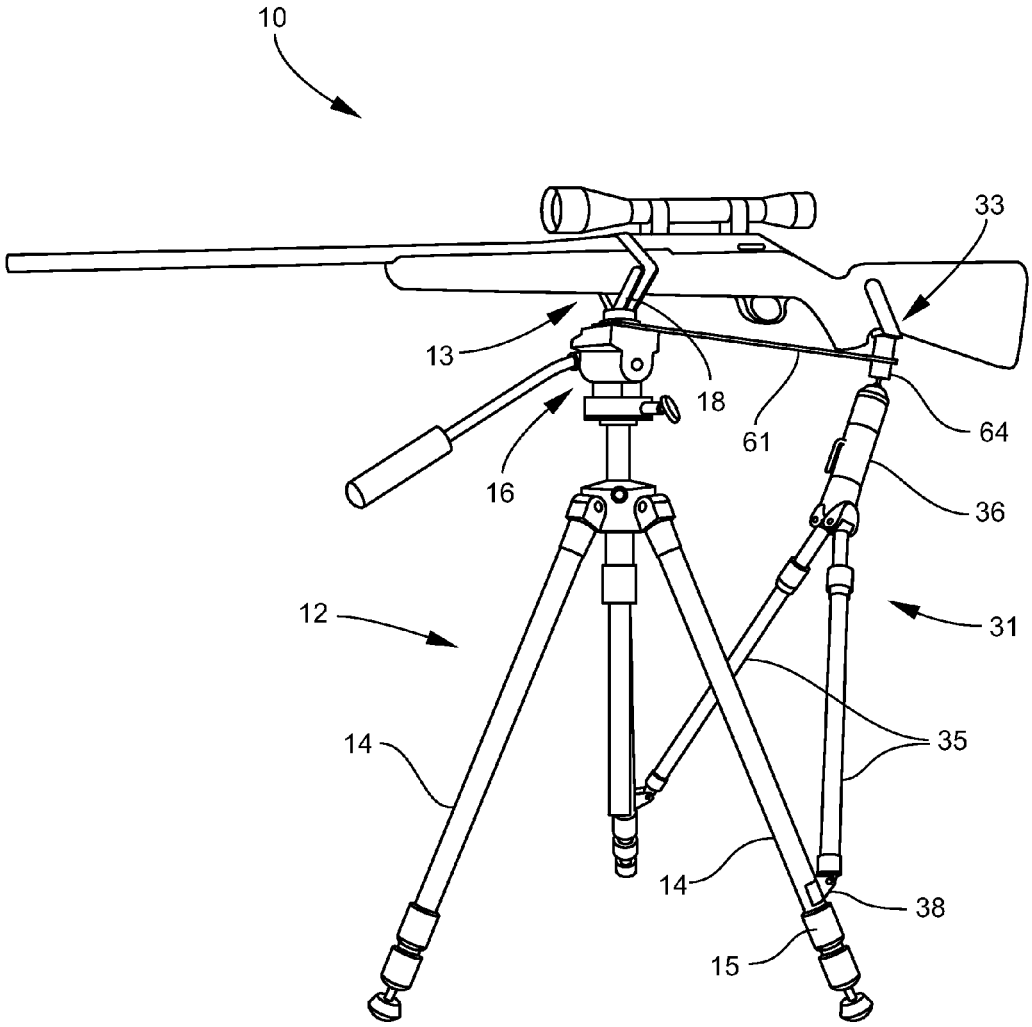
FIG. 2 is a perspective view of the rifle stand of FIG. 1.
Figure 3:
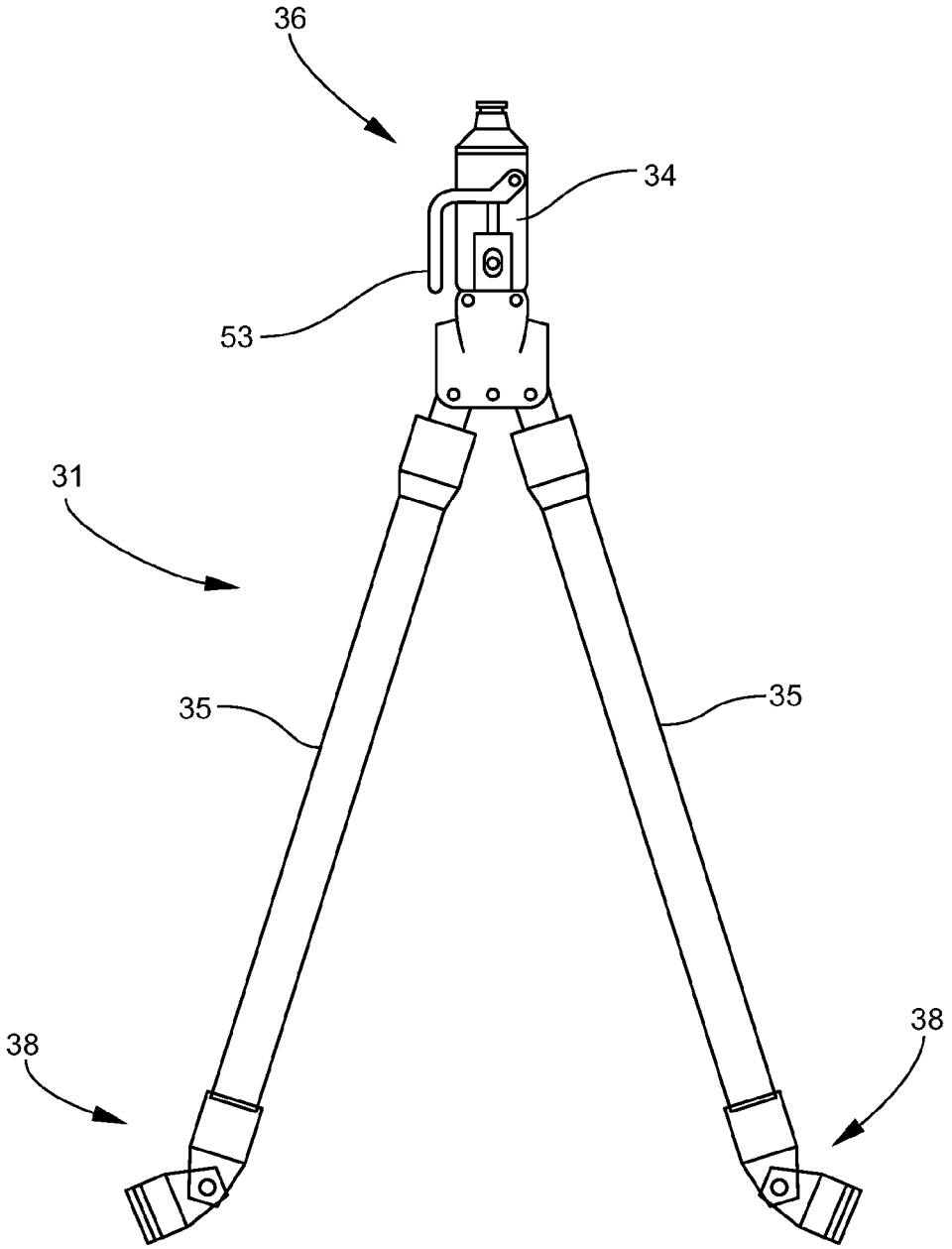
FIG. 3 is a plan view of a rear brace portion of the rifle stand of FIG. 1.

Referring now specifically to the drawings, an adjustable and lockable rifle stand according to one exemplary embodiment of the present disclosure is illustrated in FIGS. 1 through 3, and indicated generally at reference numeral 10. The rifle stand 10 comprises a three legged support 12 that sits on the ground and supports the rifle at a first support location 13 on the rifle forward of the trigger; and a two-legged rear brace 31 (see particularly FIG. 3) that supports the rifle from the three legged support 12 at a second support location 33 on the rifle, behind the trigger. The three legged support 12 is oriented with one leg extended forward, generally under the rifle barrel, and the other two legs extending back and out to the sides. The two legs 35 of rear brace 31 attach at their lower ends to the two rearward extending legs of support 12 as shown, and the upper end of brace 31 supports the back of the rifle. Connected in this manner the support 12 and brace 31 provide a stable stand, capable of holding the rifle in a fixed position.

The positioning and the relative spacing of the first and second support locations 13, 33 are selected so that the mounted rifle is stable, and without a tendency to topple over. For example, if the center of gravity (c.g.) of the rifle and stand assembly is too far rearward, the rifle will have a tendency to topple over backward. In that case the c.g. can be moved forward, and stability improved, by positioning the rifle further forward relative to the three legged support, or in other words moving the first support location 13 further rearward on the rifle. Similarly, a tendency of the mounted rifle to topple forward can be corrected by moving the first support location 13 further forward on the rifle. In any case the c.g. of the assembly must be within the footprint of the three legged support on the ground.

The inventor has discovered that a typical hunting rifle can be mounted on the rifle stand in a stable manner with the first and second supports conveniently positioned relative to certain common design features of such rifles. In particular, the second support location 33 may be conveniently positioned approximately at the juncture of the main shoulder stock and the pistol grip portion of the stock, typically several inches behind the trigger. The first support location 13 may be positioned forward of the breech and any scope mounting brackets, and generally in line with the base of the barrel, several inches ahead of the trigger. The spacing between the first and second support locations positioned in such a manner may be approximately in the range of about 12 to 16 inches, and in one particular embodiment the spacing is about 14 inches.

The three legged support 12 has three adjustable length legs 14 and a moveable head 16 at the top. In the depicted embodiments the legs comprise lockable, telescoping sections, and the head provides a platform or socket for attaching equipment, similar in those respects to a conventional collapsible tripod of the type typically used with cameras and binoculars. As in conventional tripods, the legs 14 of support 12 may be linked to a center head post that maintains all three legs at the same angle relative to the head. Alternatively the support may be configured such that the legs are independently adjustable and lockable at different angles with respect to one another. The head 16 may be any of various moveable heads commonly associated with tripods, such as ball, pan-tilt, gimbal, gear, alt-azimuth, and equatorial, to name a few. In one preferred embodiment the head 16 is a three-axis pan-tilt type head, with the ability to move independently in one or two axes by locking the unused axes.

Figure 5:
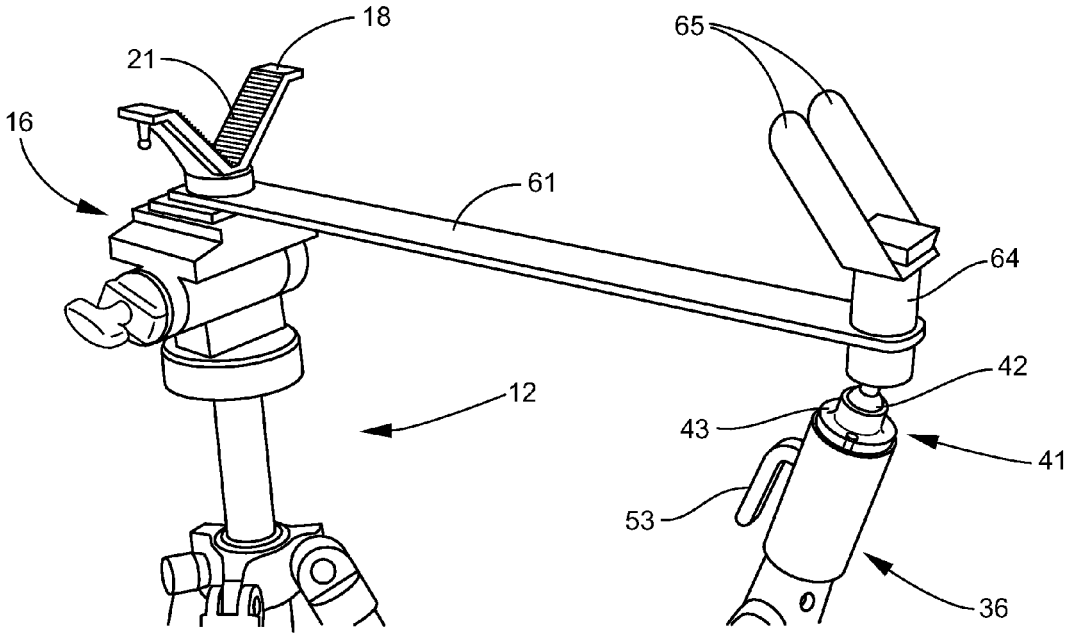
FIG. 5 is a perspective view of the upper portion of the rifle stand showing the front and rear gun supports.
Figure 6:
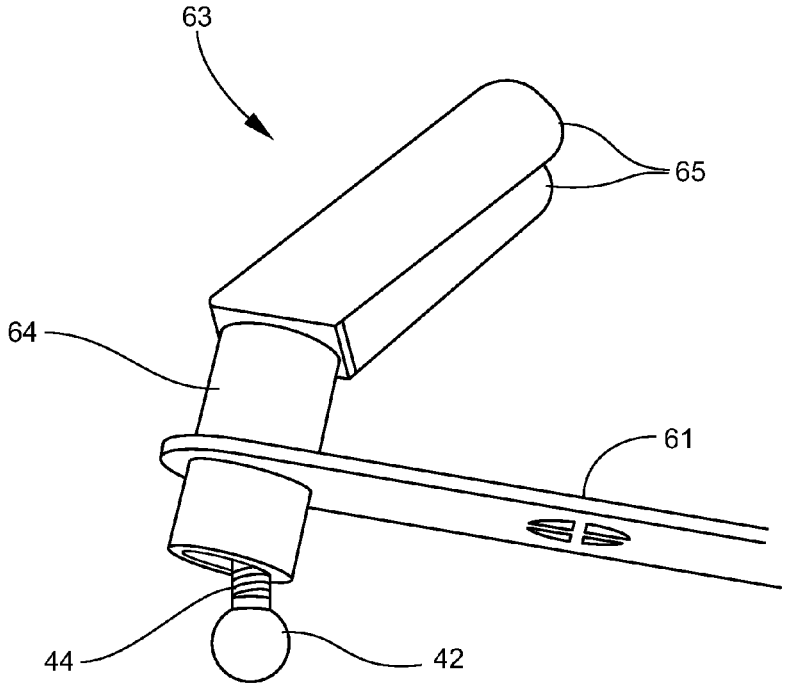
FIG. 6 shows the rear gun support and ball portion of the swivel mount.

The head 16 serves as a forward support point on which the front portion of the rifle can rest. For example, a front rifle support, or supporting surface on the head may simply comprise a flat platform. Alternatively a front rifle support may incorporate features that serve to capture the front of the rifle and prevent it from slipping off the head 16 unintentionally. In one such embodiment a front rifle support comprises a V-shaped saddle 18 as best seen in FIGS. 5 and 6. Saddle 18 may be a permanently connected, integral part of head 16, or a separate and detachably connected component. For example in one particular embodiment a beveled edge, quick release plate of the type used for mounting optical equipment to a conventional tripod may be used to detachably connect saddle 18 to head 16. The saddle may include a rubber liner 21 on the inside of the "V" to provide cushioning and reduce slip. The mounting head 16 may further include means for positively securing the forward portion of the rifle, such as the optional elastic strap 19 visible in FIG. 2 and that attaches to saddle 18. However, positively holding or securing the rifle to head 16 it is not necessary for functional operation of the present invention.

Figure 4:
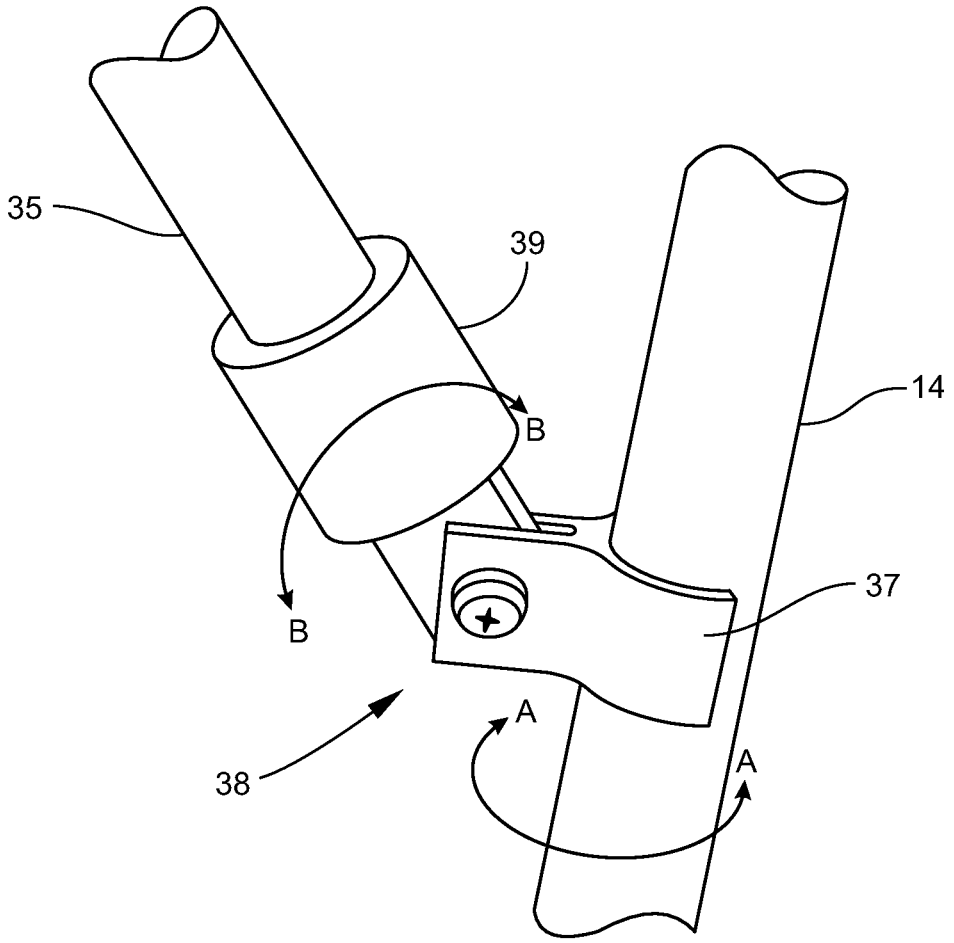
FIG. 4 is a perspective view of an exemplary universal joint attaching the legs of the rear brace to the legs of the three legged support portion of the rifle stand.

Turning now to FIGS. 3 and 4, rear brace 31 comprises two telescoping, adjustable length legs 35, pivotally connected to a head 36 at the upper ends of the legs. Like the three legged support 12, brace 31 may be an adaptation of a conventional device such as a bipod of the type typically used for supporting various equipment or weapons. The pivotal connections between the legs and head of rear support 31 are configured such that both legs pivot in the same plane, and both are free to swing independently of each other about their respective pivots at different rates or in different directions.

The lower ends of legs 35 are attached to the rear legs 14 of support 12 with a universal pivot 38 (see FIGS. 3 and 4) that allows legs 35 to pivot in all directions about legs 14. In one embodiment the connection is made near the bottom end of the main outer tube of telescoping legs 14 as shown in FIGS. 1 and 2, immediately above the locking collar 15 for locking and releasing the next leg section. If the legs 14 of support 12 are round tubes, the universal pivot 38 may be a clip arrangement as shown in FIG. 4. Specifically, the universal pivot 38 may comprise a spring clip 37 that conformably snaps around leg 14, combined with an end fitting 39 of leg 35 onto which spring clip 37 is pivotally connected. The clip 37 may be made of any rigid, high strength material, such as for example certain high strength plastics, carbon composite, spring steel, and titanium. Once snapped in place, the spring clip 37 is free to twist on leg 14 allowing the legs 35 to swing laterally relative to legs 14 as indicated by arrow A-A, while the pivot connection of clip 37 to fitting 39 allows the legs to swing toward and away from leg 14 as indicated by arrow B-B. The spring clip 37 may be prevented from sliding down leg 14 by the locking collar 15 at the bottom of the main outer leg tube. Alternatively, the attachment of legs 35 to legs 14 may comprise a ball joint, or any other type of connection that allows for uninhibited universal pivoting motion of legs 35 about legs 14.

Figure 7:
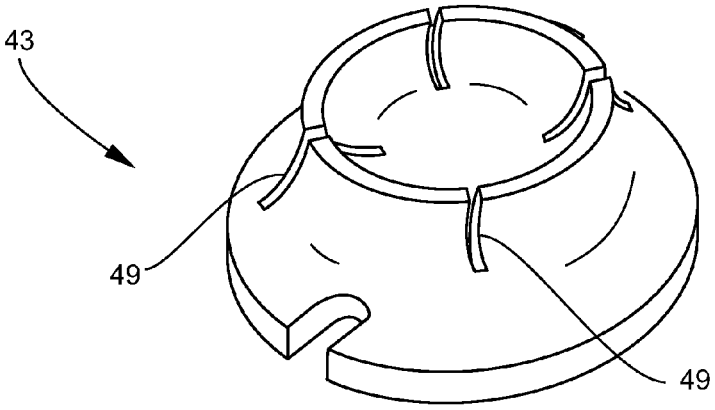
FIG. 7 is a perspective view of the swivel mount cup for receiving the ball portion of the mount visible in FIG. 6.
Figure 8:
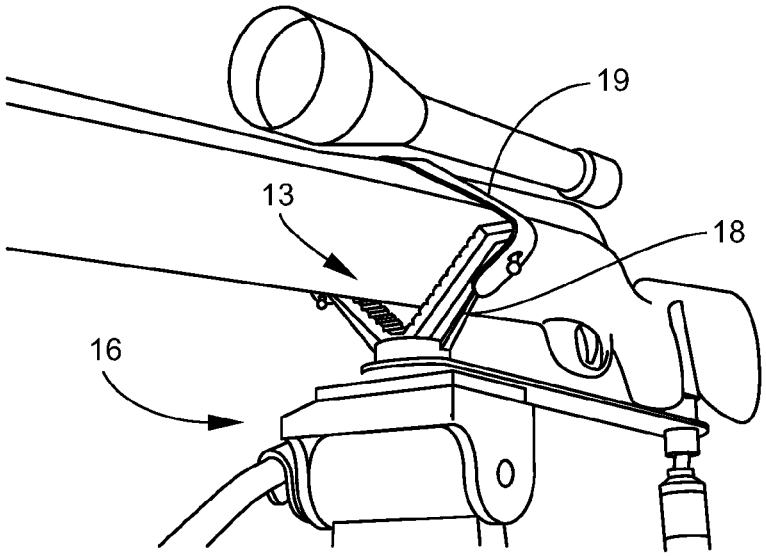
FIG. 8 is a close-up front perspective view of a rifle mounted to the rifle stand at the first support location.
Figure 9:
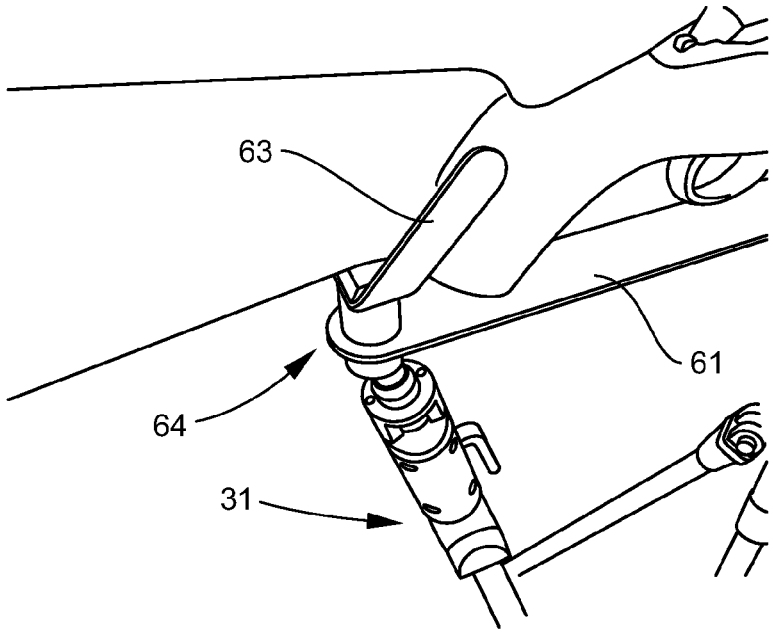
FIG. 9 is a close up rear perspective view of a rifle mounted to the rifle stand at the second support location.

Similarly, the upper end of brace 31 provides a universally pivotable connection to a rear gun support 64 and the rifle at the second support location 33. For example, referring FIGS. 5 through 7, the connection may comprise a swivel mount 41, consisting essentially of a ball 42 that securely snaps into a socket 43. Swivel mounts are sold commercially for use on devices such as tripods and bipods. The socket 43 may be made of a relatively low friction material, such as polytetrafluoroethylene (PTFE) commonly sold under the trade name Teflon®, or other similar plastics. The socket 43 may be slotted as shown in FIG. 7 to lessen or adjust the force required to attach and detach the ball. In the depicted embodiment the socket 42 has four vertical slots 49, although the number and depth of slots may be varied as necessary to achieve a proper balance between ease of assembly and securing the rifle.

The ball 42 of the swivel mount may be rigidly attached to, or an integral part of the rear gun support 64. As best seen in FIG. 6 the ball 42 may form the head of a threaded stud 44 that is screwed into a threaded hole in the bottom of rear gun support 64. Relative tilting or twisting motion between the rifle and rear brace 31 is thus accommodated by rotation of the ball 42 in the socket 43 of the swivel mount.

The rear gun support 64 further includes means for securely holding and supporting the rear portion of the rifle, such as by the generally U-shaped rifle stock clip 63 shown. The clip 63 comprises two flexible, parallel sides 65 configured with a forward tilt in order to fit snugly into depressions in the sides of a typical hunting rifle at the juncture between the shoulder stock and the pistol grip portion of the stock. The spacing between sides 65 is intentionally slightly less than width of a typical gun stock at the depressions so that sides 65 must spread apart somewhat as the gun is placed into the clip. Clip 63 may accordingly comprise a high strength material such as spring steel or titanium so that the sides can flex to accommodate the gun stock without taking a permanent set. Like saddle 18, clip 63 may be lined with rubber to provide cushioning and improve the grip to the rifle stock. It should be appreciated that various other equally effective joints and attachment schemes for connecting brace 31 to a rifle are possible and foreseeable within the scope of the present disclosure, including for example those described in the above referenced Provisional Patent Application.

The upper ends of the three legged support 12 and rear brace 31 may be connected together with a linking structure. In the embodiment shown, a rigid cross bar 61 connects the head 16 and saddle 18 of support 12 to the rear rifle support 64 atop the rear brace 31. In one embodiment the cross bar is securely connected to the front saddle 18 and rear rifle support 64, forming an integral structure that may be detached as a unit from the heads 16 and 31 for transport. In use the cross bar conveniently maintains alignment and spacing of the front and rear rifle supports, moving with the rifle without interfering with operation of the rear brace.

Figure 10:
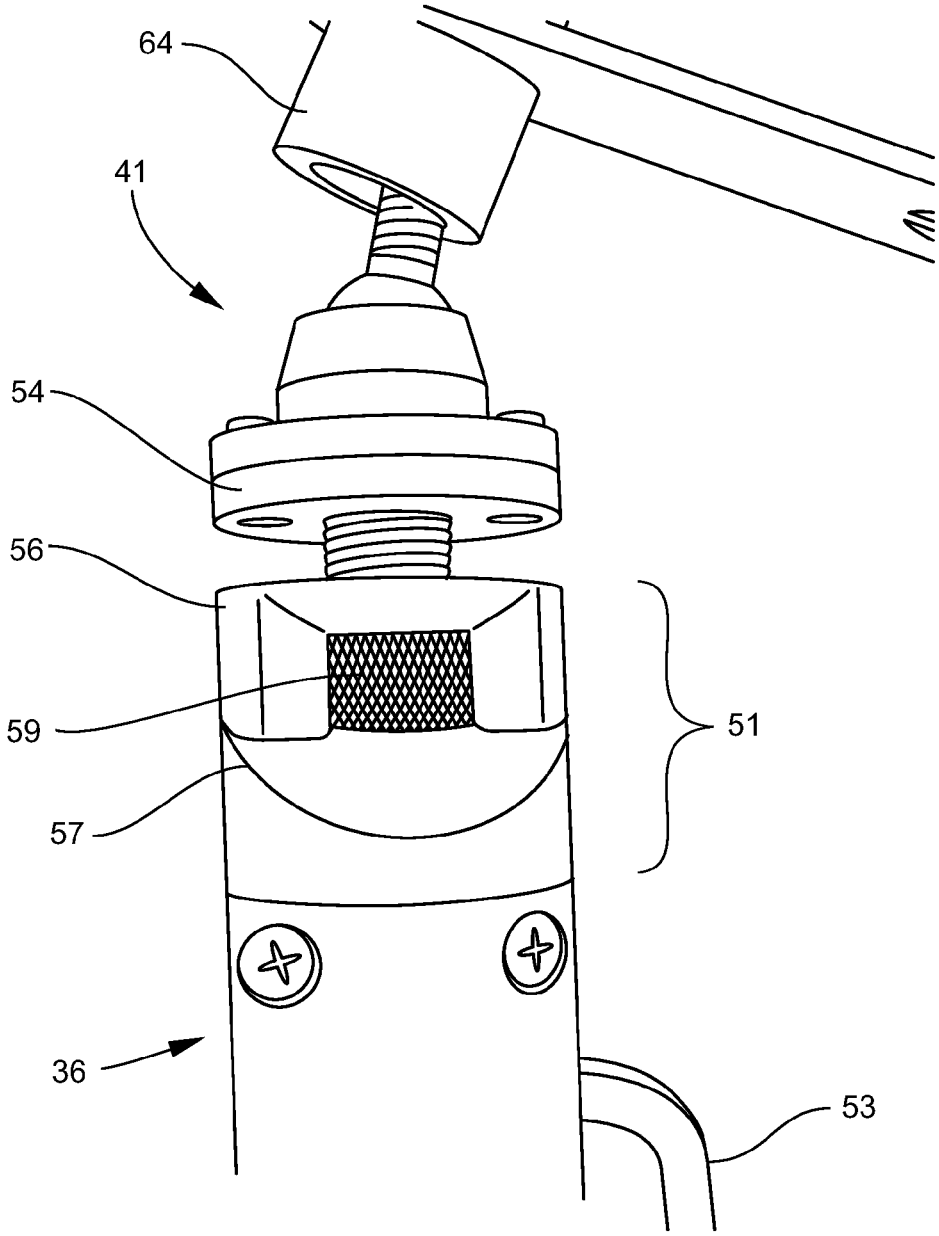
FIG. 10 is a side view of the fine adjust mechanism at the top of the rear brace.
Figure 11:
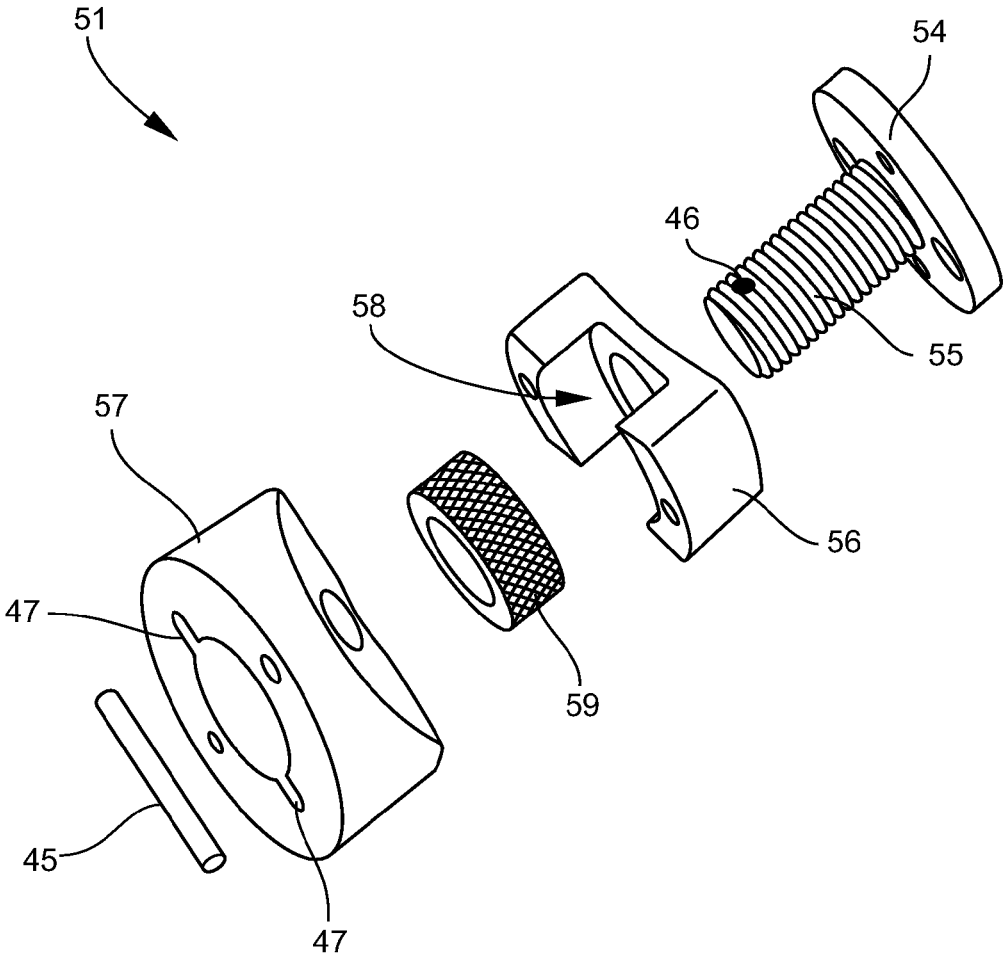
FIG. 11 is an exploded view of fine adjustment mechanism shown in FIG. 10.

Referring to FIGS. 10 and 11, the rear brace 31 may further incorporate a fine adjustment mechanism 51 adapted to make fine changes in the height of the rear gun support 64. The fine adjustment mechanism 51 is located at the top of head 36, under swivel mount 41, and comprises generally a moveable platform 54 that serves as a mounting plate for the swivel mount socket 43. An integral threaded rod 55 extending from the underside of platform 54 is received in aligned through bores in upper and lower housings 56 and 57 respectively. The diameter of the through bores is greater than the diameter of the threaded rod 55 to provide clearance around the rod. A cut-out 58 in upper housing 56 defines a space for a knurled thumb wheel 59 that is threaded onto rod 55. The upper and lower housings 56, 57 may be attached together using machine screws to create a housing assembly, trapping the thumbwheel in cut-out 58.

The threaded rod 55 is anti-rotated relative to the housing assembly using an anti-rotation pin 45 inserted through a cross-hole 46 at the lower end of threaded rod 55. The length of pin 45 is greater than the diameter of threaded rod 55 such that the pin protrudes from the rod on both sides. The protruding portions of the pin 45 are received in slots 47 in the lower housing 57. The slots 47 allow the pin 45 and threaded rod 55 to slide up or down in the housing, while preventing rotation of the rod. Thus by rotating the thumb wheel 59, the threaded rod 55 and platform 54, along with the swivel mount socket 43, are caused to move up or down relative to the housings 56, 57 without rotating. FIG. 10 shows the resulting gap created between platform 54 and the upper housing 56 when the thumbwheel 59 is operated in the described manner to raise the back end of a mounted rifle. By initially positioning platform 54 spaced above the housing as shown, the thumbwheel may be advantageously utilized to then either raise or lower the rifle as needed for fine adjustment.

The mechanism 51 may further include a pre-load spring for removing unwanted play or instability in the moving parts of the assembly. In one embodiment the pre-load spring is a coil compression spring (not shown) disposed about the threaded rod 55 in an annular space between the rod and the housing bores, and extending from the top of cut-out 58 in upper housing 56 down to the anti-rotation pin 45. The spring is configured to bias the pin 45 and threaded rod 55 downward relative to the housing assembly. The size and strength of the spring can be selected to provide a continuous downward load on the moveable rod 55 sufficient to stabilize the platform 54 without significantly interfering with normal operation of the thumb wheel 59. Alternatively, a foam or other elastic or viscous material may be used instead of or in combination with a compression spring to stabilize the platform.

Each of legs 35 of rear brace 31 may be a telescoping tube arrangement with a release mechanism such as for example the typical threaded collar, or flip tab, for unlocking the legs. So long as both legs 35 remain locked, and the rifle is attached at both rifle support locations in the manner described above, the rifle is essentially fixed in one position. However by unlocking both legs 35, the rear head 36, together with the rear gun support 64 and back end of the rifle may be moved up, down, or side to side while the front of the rifle pivots about the forward support location. At the same time the legs of brace 31 telescopically extend or contract, and pivot about their attachment points to the head 36 and to the legs 14 of three-legged support 12. Thus the rifle may be re-positioned by unlocking legs 35, pivoting the rifle from side-to-side or up-and-down about the forward support location 13 until the rifle is in a desired position, and then re-locking legs 35.

Rear brace 31 may further comprise a single point release mechanism for simultaneously unlocking both legs 35 such that they are free to telescopically extend and contract. One such suitable mechanism is described in U.S. Pat. No. 7,845,602 by Young, the entire contents of which are hereby incorporated by reference. Referring again to FIG. 3, a single point release mechanism is built into a handle portion 34 of head 36. The release mechanism is operated by a release lever 53 that when squeezed, simultaneously releases the normally locked legs 35 of brace 31. In one such release mechanism of the type described in the above referenced patent, the legs 35 comprise an upper leg tube attached to the head 36, and a lower leg tube telescopically moveable relative to the upper tube. A rod inside the upper leg tube extends from the lever 53 down to a spring loaded wedge or cam feature at the lower end of the upper leg tube that normally locks the two leg sections together. Squeezing lever 53 displaces the internal rod, causing the cam feature to unlock and release the lower leg section to telescope in or out. As long as the lever is depressed, both legs are free to telescopically extend or contract. When the lever is released, the spring loaded wedge feature returns to the normally locked position, locking the legs at their current extended or contracted position.

Thus by squeezing and holding release lever 53, the rifle may be pivotally moved and repositioned as described above. Once a desired position is found, the rifle may then be locked in that position by simply releasing lever 53. For example, while holding down release lever 53 with one hand, a person may use their shoulder or other hand to aim the rifle at a target by pivoting the rifle about the first support location 13. When the target is acquired, the lever can be released, locking the rifle on the target. Unless the target subsequently moves the rifle will then stay on target until the rifle is fired. The aim may be further refined at that point by operating the fine adjust mechanism to slightly raise or lower the back of the rifle as needed.

The three legged support 12 may also be equipped with a single point leg release of the type described above in reference to the rear brace. For example the support 12 may include a handle and release lever, such as rear brace handle 34 and lever 53, at the top of legs 14, operably connected to locking mechanisms built into each of the legs 14. The connection and locking mechanisms may be configured such that depressing the lever unlocks the locking mechanisms in all three legs simultaneously allowing the legs to then telescopically extend or contract.

It should be appreciated that a single point leg release on support 12 may be advantageously used to quickly level the rifle stand on uneven terrain. For example, by holding the support 12 above the uneven terrain and activating the single point release (such as by squeezing a release lever), each leg will naturally telescopically extend until coming into contact with the ground. The amount each leg extends will depend upon the contour of the terrain and the orientation of the support 12. Once all three legs are resting on the ground, and the handle and head of support 12 are at a desired height, the legs may then be locked by simply disengaging the release (such as by letting go of a release lever).

When used in the field, the rifle support may be broken down for transport with support 12 and brace 31 disconnected from each other and collapsed, and then re-assembled at a location where the rifle is to be fired. Once assembled, the legs of forward support 12 may be individually adjusted in length and/or angle to accommodate uneven ground, and to place the rifle at a suitable height. It should be appreciated that a suitable height may vary depending on the position from which the rifle is to be fired. If necessary, the head 16 of forward support 12 may then be adjusted to level the rifle to allow the rifle to pan in a somewhat level plane. Depending on the head design, one of the axes may be tightened or locked to ensure that the gun stays level during use. The rifle may then be aimed and locked in position for firing in the manner described above.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A rifle stand, comprising:

a three legged support with a moveable first head adapted to hold a rifle at a first support location on the rifle forward of the trigger, wherein the three legged support is a tripod with telescopically extendable legs that converge at the first head, and wherein the first head is a pan head configured to allow pivoting movement of a rifle about the first support location;

a rear brace with two extendable legs pivotally connected at their upper ends to a second head adapted to hold a rifle at a second support location on the rifle behind the trigger, the lower ends of the two legs each pivotally connected to a leg of the three legged support, wherein each extendable leg of the rear brace incorporates a leg extension lock operable to lock the legs and prevent extension or contraction of the locked leg;

a ball and socket mount, wherein a ball portion of the ball and socket mount is connected to a lower end of a rear rifle support, and a socket portion of the ball and socket joint is mounted atop the second head; and a fine height adjustment mechanism disposed between the second head and the socket portion of the ball and socket joint, the fine height adjustment mechanism comprising a moveable portion attached to the socket portion of the ball and socket joint, and a fixed portion attached to the second head, wherein the moveable portion and rear rifle support may be displaced relative to the fixed portion by rotating a thumb wheel.

2. The rifle stand of claim 1, further comprising a release lever attached to a handle portion of the second head, the release lever operatively connected to the leg extension lock of each leg, wherein depressing the release lever simultaneously unlocks both leg extension locks, allowing the legs to extend or contract as long as the release lever is depressed.

3. The rifle stand of claim 2, wherein each leg of the rear brace comprises an upper leg tube pivotally attached to the second head, and a lower leg tube telescopically movable with respect to the upper leg tube.

4. The rifle stand of claim 3, wherein the leg extension lock comprises a spring loaded wedge device in the lower end of each upper leg tube that normally locks the lower tube in place, and wherein depressing the release lever actuates the spring loaded wedge device, unlocking the lower tube.

5. The rifle stand of claim 1, further comprising a cross bar rigidly connecting the first head to the second head.

6. The rifle stand of claim 5, wherein the cross bar maintains a spacing between the first and second support locations of approximately 12 to 16 inches.

7. The rifle stand of claim 1, wherein the rear rifle support comprises a U-shaped clip with two flexible, parallel sides configured to fit tightly against the sides of a typical hunting rifle generally at the juncture between the shoulder stock and the pistol grip portion of the stock.

8. A rifle stand, comprising:

a tripod with a pivoting first head adapted to support a rifle at a first support location on the rifle forward of the trigger;

a rear brace with two extendable legs, the lower ends of the legs pivotally connected respectively to two legs of the tripod, and the upper ends of the extendable legs connected to a second head adapted to support a rifle at a second support location on the rifle behind the trigger;

a leg extension lock built into each of the two extendable legs of the rear brace, the leg extension locks operable to lock the legs and prevent extension or contraction of the locked leg;

a rear rifle support adapted to securely hold a rifle at the second support location, and a universal joint connecting the rear rifle support to the second head;

a rigid cross bar connecting the first head to the rear rifle support; and a fine height adjustment mechanism disposed between the second head and the universal joint, the fine adjustment mechanism comprising a threaded rod attached to the universal joint, a housing attached to the second head, and a rotatable thumb wheel on the threaded rod operable to cause vertical displacement of the threaded rod relative to the housing.

9. The rifle stand of claim 8, wherein the universal joint comprises a ball and socket mount in which a ball portion of the universal joint is connected to a lower end of the rear rifle support, and a socket portion of the universal joint is attached to the threaded rod.

10. The rifle stand of claim 8, wherein the rear rifle support comprises a U-shaped clip with two flexible, parallel sides configured to fit tightly against the sides of a typical hunting rifle generally at the juncture between the shoulder stock and the pistol grip portion of the stock.

11. The rifle stand of claim 8, wherein the cross bar maintains a spacing between the first head and the rear rifle support of approximately 12 to 16 inches.

12. The rifle stand of claim 8, further comprising a single point leg release on the second head connected to the leg extension locks and operable to unlock both leg extension locks simultaneously.

* * * * *